US009421443B2

(12) United States Patent
Boyer et al.

(10) Patent No.: US 9,421,443 B2
(45) Date of Patent: Aug. 23, 2016

(54) FLOATING GAME DEVICE

(75) Inventors: Céline Boyer, Vic la Gardiole (FR); Antoine Harpages, Saint Jean de Luz (FR); Yannick Rolland, Ciboure (FR); Damien Saumureau, Ciboure (FR)

(73) Assignee: DECATHLON, Villeneuve d'Ascq (FR)

( * ) Notice: Subject to any disclaimer, the term of this patent is extended or adjusted under 35 U.S.C. 154(b) by 169 days.

(21) Appl. No.: 14/000,607

(22) PCT Filed: Feb. 22, 2012

(86) PCT No.: PCT/FR2012/050374

§ 371 (c)(1),
(2), (4) Date: Oct. 28, 2013

(87) PCT Pub. No.: WO2012/114043

PCT Pub. Date: Aug. 30, 2012

(65) Prior Publication Data

US 2014/0054858 A1 Feb. 27, 2014

(30) Foreign Application Priority Data

Feb. 22, 2011 (FR) ..... 11 51422

(51) Int. Cl.

| | |
|---|---|
| ***A63B 63/00*** | (2006.01) |
| ***A63B 67/00*** | (2006.01) |
| *B63B 35/73* | (2006.01) |

(52) U.S. Cl.

CPC ..... *A63B 63/00* (2013.01); *A63B 67/007* (2013.01); *A63B 2225/605* (2013.01); *B63B 35/73* (2013.01)

(58) Field of Classification Search

CPC ..... A63B 2225/605; A63B 2225/62; A63F 2250/205

USPC ..... 273/349, 350, 398–402; 473/476–478

See application file for complete search history.

(56) References Cited

U.S. PATENT DOCUMENTS

| | | | | | |
|---|---|---|---|---|---|
| 3,350,097 | A | * | 10/1967 | Chevrette et al. | 273/350 |
| 3,403,907 | A | * | 10/1968 | Keller | 273/350 |
| 3,469,844 | A | * | 9/1969 | Sindelar | 273/350 |
| 3,613,097 | A | * | 10/1971 | Daughenbaugh | 342/10 |
| 3,652,090 | A | * | 3/1972 | Semmens | 273/336 |
| 3,656,749 | A | * | 4/1972 | Reyes | 473/485 |
| 3,895,801 | A | * | 7/1975 | Baird | 273/350 |
| 3,989,250 | A | * | 11/1976 | Lakeman | 273/350 |

(Continued)

*Primary Examiner* — Mark Graham

(74) *Attorney, Agent, or Firm* — MH2 Technology Law Group, LLP

(57) ABSTRACT

The invention relates to a floating game device (1) comprising a submerged part (3), an above-water part (2) and a floating element (4). The above-water part includes a first structure (5) and a first flexible surface (6) supported by the first structure, the floating element constitutes a waterline delimiting the submerged part from the above-water part, and the submerged part comprises a second structure (7) and a second flexible surface (8) supported by the second structure. Assembly means are configured to keep the first structure and the second structure assembled with the floating element, in a plane forming an angle with said waterline, said floating element having a part that is offset relative to the plane formed by the first and second structures. The second flexible surface is configured on the submerged part to form a resistance means in the water, at least one of the first and second flexible surfaces being fixed with the floating element offset relative to the plane formed by the first and second structures.

28 Claims, 5 Drawing Sheets

(56) References Cited

U.S. PATENT DOCUMENTS

| | | | | |
|---|---|---|---|---|
| 4,799,910 | A * | 1/1989 | Kellough | 441/131 |
| 5,722,446 | A * | 3/1998 | Zheng | 135/125 |
| 6,030,300 | A * | 2/2000 | Zheng | 473/471 |
| 6,173,957 | B1 * | 1/2001 | James, Sr. | 273/440 |
| 6,220,975 | B1 | 4/2001 | Beazley | |
| 7,207,857 | B2 * | 4/2007 | Zheng | 441/130 |
| 7,210,685 | B2 * | 5/2007 | Cheng | 273/348.4 |
| 7,360,767 | B2 * | 4/2008 | Merccica | 273/350 |
| 7,464,937 | B1 * | 12/2008 | Maggio | 273/350 |
| 2001/0024924 | A1 | 9/2001 | Ueno | |
| 2002/0096101 | A1 * | 7/2002 | Hansen | 114/345 |
| 2004/0102260 | A1 | 5/2004 | Chia | |
| 2004/0221885 | A1 * | 11/2004 | Zheng | 135/126 |
| 2008/0143052 | A1 * | 6/2008 | Paslawski | 273/350 |
| 2009/0081919 | A1 | 3/2009 | Zheng | |
| 2013/0093138 | A1 * | 4/2013 | Fraser et al. | 273/350 |
| 2015/0048572 | A1 * | 2/2015 | Hochschild et al. | 273/350 |

* cited by examiner

FLOATING GAME DEVICE

CROSS REFERENCE TO RELATED APPLICATIONS

This application is a US National Stage entry of International application No PCT/FR2012/050374 filed Feb. 22, 2012 and claiming priority to French application FR 11 51422 filed Feb. 22, 2011, the entire disclosures of which are hereby incorporated herein by reference in their entireties.

TECHNICAL FIELD OF THE DISCLOSURE

The present invention relates to a floating game device making it possible to play or perform athletic activities in a swimming pool or in a body of water such as a lake, these athletic activities for example being such as water polo, kayak polo, water volleyball or others. The invention in particular relates to means for stabilizing the floating game device.

BACKGROUND OF THE DISCLOSURE

The known floating game devices typically make it possible to perform athletic activities or play in the water. Among these floating game devices, a first type consists of a floating element and an above-water part, positioned above said floating element and including a first structure as well as a first flexible surface, in particular of the net type, supported by said first structure for example to form a cage for receiving the ball, in particular when it involves playing water polo or kayak polo, or even to form a transversely stretched net, in particular to play water volleyball. One drawback of this type of floating game device is that it drifts and is unstable in the water, in particular due to the waves generated by the movements of the people in the water, or the kayaks and paddles, or due to the wind or current that may exist in the body of water when it is a natural body of water such as a lake or pond. To offset this drawback, floating game devices are known that have means for mooring the floating element to a stationary element, in particular the edge of the pool in which the floating game device is positioned. Such a device is for example described in document U.S. Pat. No. 6,220,975. This, however, requires the game device to be used in a pool and near the edges of that pool. Also known are devices such as those described in documents US 2009/0081919 and U.S. Pat. No. 3,895,801 that include a submerged part, an above-water part including a first structure and a first flexible surface borne by the first structure and configured for play, for example by forming a volleyball net or cage and a floating element positioned in a waterline and arranged to delimit the submerged part from the above-water part. The submerged part is configured to form means for stabilizing the above-water part and the floating element. According to document U.S. Pat. No. 3,895,801, these stabilization means consist of weights fixed to the floating element and making it possible to ballast the floating game device. According to document US 2009/0081919, the submerged part consists of a second structure on which a second flexible surface is stretched making it possible to form a panel configured to play underwater. The second structure further comprises weights making it possible to ballast the floating game device. The presence of such weights on the submerged part of the floating game device, as described in documents U.S. Pat. No. 3,895,801 and US 2009/0081919, has the drawback of making said device heavier, in particular when the device needs to be handled so as to be taken out of the water and put away.

The present invention aims to implement a floating game device that has stabilization means whereof the design optimizes the stabilization and reduces the weight of said floating game device so as to facilitate its handling when removed from the body of water and its transport, for example to store it or even move it on another body of water.

SUMMARY OF THE DISCLOSURE

To that end, the invention relates to a floating game device comprising a submerged part, an above-water part and a floating element. The above-water part includes a first structure and a first flexible surface supported by that first structure. The floating element constitutes a waterline that delimits the submerged part from the above-water part, the submerged part comprising a second structure and a second flexible surface supported by that second structure. Assembly means are configured to keep the first structure and the second structure assembled with the floating element, in a plane forming an angle with said waterline, said floating element being configured to extend at a distance from the first and second structures positioned in said plane. This angle will preferably be comprised between 30° and 150°, for example 90°. Furthermore, according to the invention, the second flexible surface is configured on the submerged part to form a resistance means in the water. Furthermore, at least one of the first and second flexible surfaces is fixed with the floating element at a distance from said plane.

It will be understood that under normal usage conditions, on a calm body of water, the submerged part and the above-water part are positioned in a plane forming an angle with the floating element positioned in the waterline. When the body of water is agitated, the resistance in the water procured by the submerged part aims to keep the above-water part in a stable position, in a vertical plane above the body of water. Furthermore, the shift of the floating element relative to the above-water and submerged parts, as well as the fastening of at least one of the first or second flexible surfaces on an offset part of the floating element, result in transferring the force onto said offset part of the floating element, which tends to rise, or, conversely, dive relative to the plane of the water, when the submerged and above-water parts defined in a same plane tilt relative to the vertical plane. The inverse force exerted by the water on the floating element aims on the contrary to keep the latter in the waterline, that force being transferred onto the above-water part or the submerged part by means of the first or second flexible surface—depending on that which is fixed to the floating element—which makes it possible to keep said above-water and submerged parts in the plane forming an angle with the floating element. Thus, the floating game device remains suitably stable without using weights for additional ballasting, which favors the handling thereof.

According to a first embodiment of the floating game device according to the invention, the floating element has a bowed configuration delimited by two lateral ends, an inner edge and an outer edge. Furthermore, the first structure is a first hoop including two ends respectively subject to the two side ends of the floating element. Furthermore, the first flexible surface is configured to be fixed to the first bow and with one of the inner or outer edges of the floating element, in a more or less stretched position so as to form a cage for receiving the ball.

According to one embodiment, the second structure comprises at least two tubular portions respectively subjected to the two side ends of said floating element. Furthermore, the second flexible surface is configured to be fixed to said at least two tubular portions of the second structure and to the inner or outer edge to which the first flexible surface is fixed, in a more or less stretched position so as to form a volume. This configuration of the second flexible surface has the advantage of optimizing the resistance of the floating game device to the movements in the water, aiming to stabilize said floating game device. The term "tubular" is used in this description; it may, however, use circular or noncircular bars or rods without going beyond the scope of the invention.

According to this first design embodiment, the second structure is preferably an arch having two ends respectively subjected to the two lateral ends of the floating element, the second flexible surface being fixed to the second arch.

According to one embodiment of this first design embodiment, the floating element is crescent-shaped. Furthermore, the first flexible surface and, optionally, the second flexible surface are fixed on the outer edge of the crescent.

According to one alternative embodiment of this first design embodiment, the floating element has a toroid portion shape. Further, the first flexible surface and, optionally, the second flexible surface are fixed on the inner edge of the toroid portion. Additionally, a third flexible surface extends toward the inside of the floating element from the inner edge of said floating element, in the waterline.

According to the inventive floating game device, the assembly means are configured to bend the first and second structures. Furthermore, return means are configured to exert a force on the first structure and the second structure so as to position them naturally in a position that is more or less perpendicular relative to the floating element. This has the advantage of being able to curve the first structure and the second structure relative to the floating element and automatically redeploy the floating game device. Furthermore, a tensing system is arranged between the floating element and at least the second structure to keep said second structure curved relative to the floating element so as to limit the bulk of said second structure heightwise. This has the advantage of making it possible to use the floating game device on bodies of water having little bottom.

According to the inventive floating game device, the first structure and the second structure are made up of a single and same flexible arch comprising two side portions. Furthermore, fastening means are arranged between the two lateral sides of the floating element and the two respective side portions of the flexible arch.

According to a second design embodiment of the inventive floating game device, the floating element is rectangular comprising two lateral sides and two longitudinal sides.

According to the second design embodiment, the first structure comprises at least two upper lateral bars respectively positioned on the two lateral sides and extending perpendicular to the floating element. Furthermore, the first flexible surface is fixed to the two lateral upper bars. It is, however, also possible to consider a transverse upper bar connecting the ends of the two upper lateral bars, to which the first flexible surface can also be fixed.

According to the second embodiment, the second structure comprises two lateral lower bars and one transverse lower bar positioned in a U, the lateral lower bars respectively being fixed to the lateral sides of the floating element. Furthermore, the second flexible surface has a rectangular shape comprising two longitudinal ends that are fixed to the longitudinal sides of the floating element, said second flexible surface being stretched bearing against the lower transverse bar. This also makes it possible to form a volume in the form of a pouch offering resistance in the water.

According to this second design embodiment, the second structure comprises at least two lateral lower bars respectively subjected to the two lateral sides of the floating element. Furthermore, the second flexible surface is configured to be fixed to the two lower lateral bars and with one of the inner or outer edges of the floating element, in a more or less stretched position so as to form a volume.

According to the inventive floating game device, at least one fastening system is configured on the floating element to allow mooring or complementary ballasting of said floating element, in particular when the floating game device is used on an agitated body of water.

According to the inventive floating game device, the first flexible surface is a net. Furthermore, the second flexible surface is made from a textile, for example cloth.

According to one alternative embodiment of this first flexible surface, in particular when the game device is implemented according to the first design embodiment, said first flexible surface includes a fabric peripheral contour whereof an outer edge is fixed to the floating element and to the first arch and a central net whereof the peripheral edge is fixed to an inner edge of said peripheral contour.

According to an alternative embodiment of this second flexible surface, in particular when the floating game device is implemented according to the first design embodiment and the second structure consists of an arch, said second flexible surface includes a peripheral cloth contour whereof an outer edge is fixed to the floating element and to the second arch and a central net whereof the peripheral edge is fixed to an inner edge of said peripheral contour.

According to one embodiment of the inventive floating game device, a sheath is fastened to the first structure and the second structure, the floating element being flexible and configured to be inserted into the sheath.

According to one embodiment of the floating game device according to the invention, the floating element is deformable, in particular when said floating element is flexible or made up of several floating parts, which tends to deform the first structure and the second structure affixed to said floating element. To that end, a stiffening system is configured on at least one of the first and second structures to keep the first and second structures in a stable position.

BRIEF DESCRIPTION OF THE DRAWINGS

The following description illustrates different design alternatives of the inventive floating game device. The description of these design alternatives is based on figures, in which.

MORE DETAILED DESCRIPTION

Figure 2:
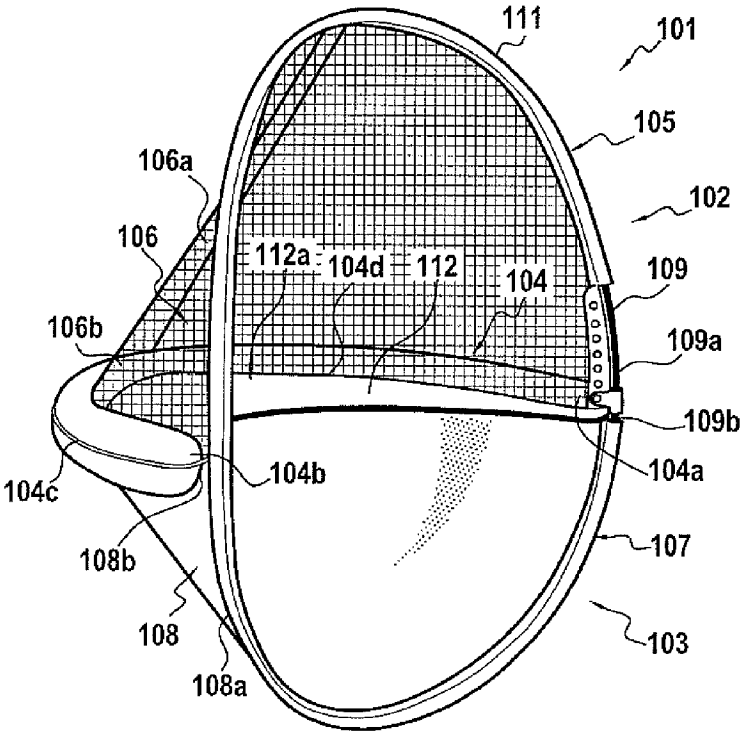
FIG. 2 illustrates a design alternative of the floating game device according to which the floating element has a toroid portion shape.

FIGS. 1 to 7 show that the floating game device 1, 101, 201, 301, 401 in all cases includes an above-water part 2, 102, 202, 302, 402 and a submerged part 3, 103, 203, 303, 403 that makes it possible to form a volume improving the resistance in the water. This above-water part and this submerged part are separated by a floating element 4, 104, 204, 304, 404 that defines a waterline.

One can see that the above-water part includes a first structure 5, 105, 205, 305, 405 and a first flexible surface 6, 106, 206, 306, 406. Likewise, the submerged part comprises a second structure 7, 107, 207, 307, 407 and a second flexible surface 8, 108, 208, 308, 408.

Figure 1:
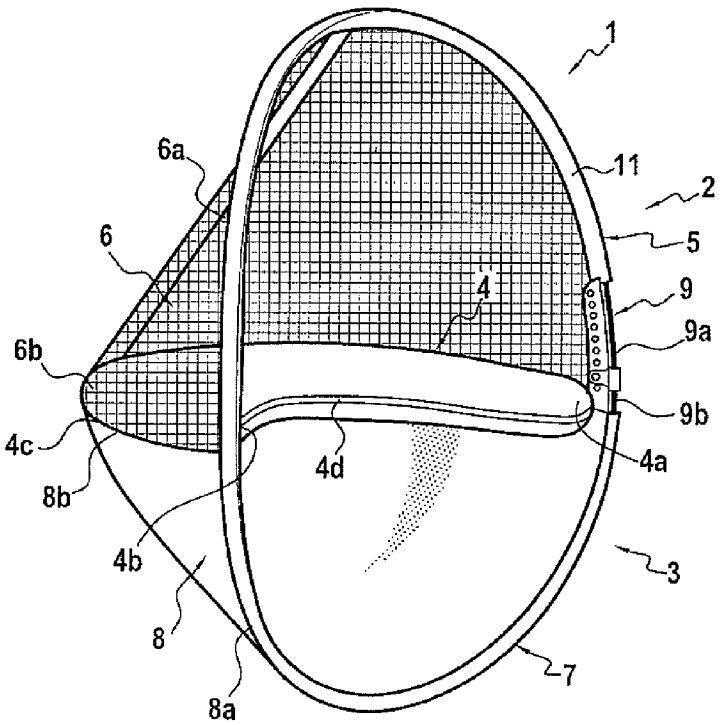
FIG. 1 illustrates a floating game device according to a first embodiment according to which the floating element is crescent-shaped.

FIG. 1 shows that the floating element 4 comprises a crescent shape. The first structure 5 and the second structure 7 are implemented using a single and same flexible arch 9 closed on itself, i.e., the first end 9*a* and the second end 9*b* of the flexible arch 9 come together and are fixed to each other using a fastening part for example making it possible to interlock said first and second ends 9*a*, 9*b*. One can see that this arch is positioned inside a sheath 11 and that the sheath is fixed at the lateral ends 4*a*, 4*b* of the floating element 4. This fastening is for example done by sewing, welding, gluing or other means. Furthermore, the first flexible surface 6 is made up of a net whereof one of the edges 6*a* is fixed to the sheath 11 for example by sewing or welding. Furthermore, the second edge 6*b* of the net is fixed with the outer edge 4*c* of the floating element 4, for example by welding, sewing or gluing. Furthermore, the second flexible surface 8 is made up of a textile, for example cloth whereof one of the edges 8*a* is fixed to the sheath 11 and whereof the other edge 8*b* is fixed with the outer edge 4*c* of the floating element 4.

The use of a single and same flexible arch 9 as illustrated in FIG. 1 has the advantage of being able to bend the first structure 5 relative to the second structure 7, said flexible arch offering a return force in a normal equilibrium position as illustrated in FIG. 1 according to which the first structure 5 and the second structure 7 formed using the arch 9 are positioned naturally, perpendicular relative to the floating element 4 positioned in a waterline. Of course, it is possible to consider implementing this first structure 5 and the second structure 7 using two independent arches whereof the lateral ends would be positioned adjoining and fixed to the lateral ends 4*a*, 4*b* of the floating element 4. It is further possible to provide return means, for example flexible tips or springs, in which the ends of the arches would snap, offering a return force making it possible to bring said arches back perpendicular to the floating element 4.

The floating game device 101 illustrated in FIG. 2 has a design similar to that of the floating game device illustrated in FIG. 1 regarding the implementation of the first structure 105, the second structure 107, the first flexible surface 106 and the second flexible surface 108. Thus, the first structure 105 and the second structure 107 are implemented using a single and same flexible arch 109 whereof the first end 109*a* and the second end 109*b* come together and are fixed to each other using a fastening part making it possible for example to snap said first and second ends 109*a*, 109*b*. Furthermore, the flexible arch is positioned in a sheath 111 that is fixed with respect to the lateral ends 104*a*, 104*b* of the floating element, said fastening being able to be done by sewing, welding, gluing or other means. However, according to this FIG. 2, the floating game device 101 comprises a floating element 104 that assumes the form of a toroid portion. Furthermore, the first edge 106*a* the first flexible surface 106 is fixed on the sheath 111 and the second edge 106*b* is fixed on the inner edge 104*d* of the floating element 104. Likewise, the first edge 108*a* of the second flexible surface 108 is fixed on the sheath 111 and the second edge 108*b* is fixed on the inner edge 104*d* of the floating element 104. One can also see the presence of a third flexible surface 112 positioned in the waterline, the edge 112*a* of said third flexible surface being fixed to the inner edge 104*d* of the floating element 104 and extending in the waterline of the floating element 104. This third flexible surface is for example made from cloth.

Figure 3:
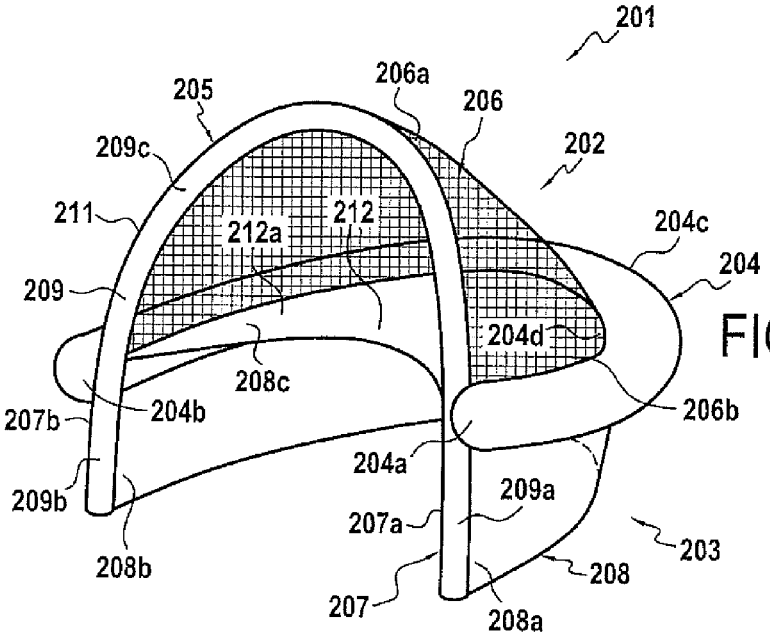
FIG. 3 illustrates a design alternative of the submerged part of the floating game device according to FIG. 2.

According to the design alternative illustrated in FIG. 3, one can see that the floating game device 201 comprises a floating element 204 that has a toroid portion shape similar to the floating element 104 illustrated in FIG. 2. In this FIG. 3, one can see that the first structure 205 and the second structure 207 are implemented using a single and same flexible arch that is curved in the shape of an upside down U; the lateral end portions 209*a*, 209*b* of this flexible arch 209 are positioned below the floating element 204 and form two tubular portions 207*a*, 207*b* of the second structure 207. Furthermore, the central portion 209*c* of this flexible arch is positioned above the floating element 204 and forms the first structure 205. This flexible arch 209 is positioned in a sheath 211 that is fixed at its lateral sides with the lateral ends 204*a*, 204*b* of the floating element 204. Furthermore, the first flexible surface 206 has a first edge 206*a* fixed on the sheath 211 and a second edge 206*b* fixed on the inner edge 204*d* of the floating element 204. The second flexible surface 208 is in the shape of a strip whereof the lateral ends 208*a*, 208*b* are fixed on the sheath 211 at the tubular portions 207*a*, 207*b*, while the upper edge 208*c* of that strip is fixed on the inner edge 204*d* of the floating element 204. This arrangement of the strip makes it possible to form a volume offering resistance in the water and ensuring the connection between the floating element 204 and the second structure 207. It is also possible to consider implementing a third flexible surface 212 whereof the edge 212*a* is fixed to the inner edge 204*d* of the floating element 204, said third flexible element 212 extending in the waterline of the floating element 204.

Figure 4:
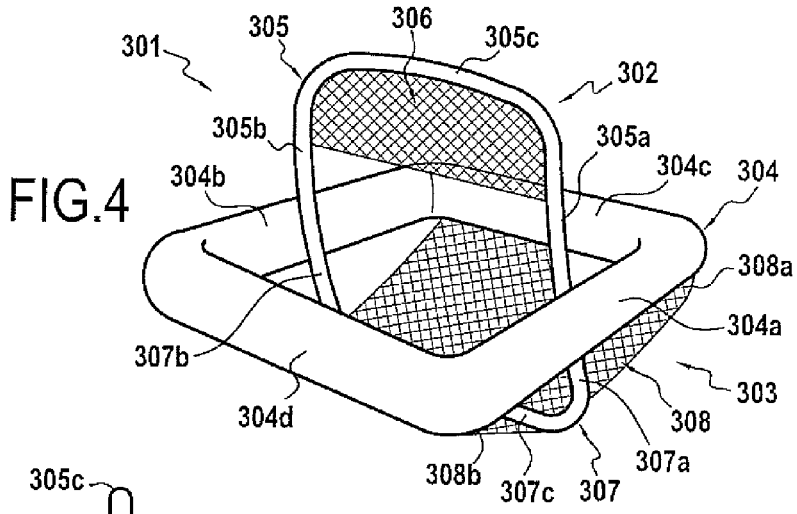
FIGS. 4 and 5 illustrate a design alternative of the floating game device in which the floating element is rectangular.
Figure 5:
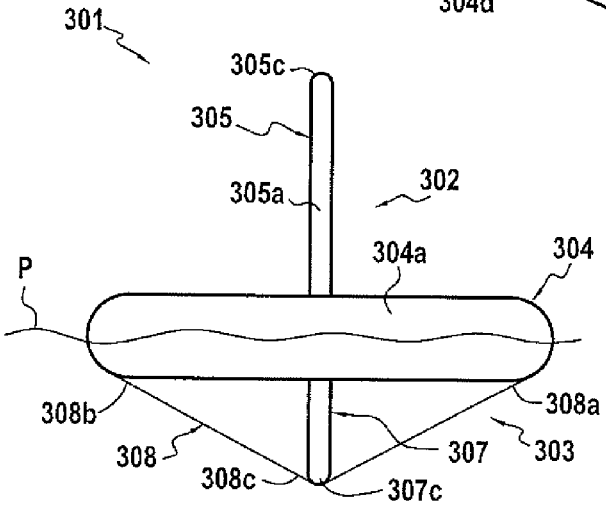

According to the alternative design illustrated in FIGS. 4 and 5, the floating game device comprises a rectangular floating element 304 that has two lateral sides 304*a*, 304*b* and two longitudinal sides 304*c*, 304*d*. One can see that the first structure 305 comprises two lateral upper bars 305*a*, 305*b* and a transverse upper bar 305*c* connected to the two lateral upper bars 305*a*, 305*b*, the first structure 305 forming an upside down U. Likewise, the second structure 307 comprises two lateral lower bars 307*a*, 307*b* and a transverse lower bar 307*c* connected to the lower ends of the two lower lateral bars 305*a*, 305*b*, said second structure 307 forming a U.

FIG. 4 shows that the upper lateral bars 305*a*, 305*b* and the respective lower lateral bars 307*a*, 307*b* are formed using a single and same flexible bar fixed at the lateral sides 304*a*, 304*b* of the floating element 304. Using flexible lateral bars has the advantage of making it possible to fold the upper structure 305 relative to the lower structure 307, the flexibility offering a return force that makes it possible to bring said upper 305 and lower 307 structures back perpendicular relative to the floating element 304 above and below the latter.

One can see that the first flexible surface 306 is made up of a net that is fixed at the lateral upper parts 305*a*, 305*b*. It is also possible to consider fastening said net at the upper transverse bar 305*c*.

FIGS. 4 and 5 show that the second flexible surface 308 comprises a rectangular shape having two longitudinal sides 308*a*, 308*b* respectively fixed to the longitudinal sides 304*c*, 304*d* of the floating element 304. Furthermore, the second flexible surface 308 passes below the lower transverse bar 307*c* of the second structure 307, which makes it possible to keep the central portion 308*c* of said second flexible surface 308 bearing against the lower transverse bar 307*c*, as illustrated in FIGS. 4 and 5, and thus to stretch said second flexible surface 308 that forms a pouch below the floating element 304 offering resistance in the water. The second flexible surface 308 is implemented using the net. It is, however, possible to consider using other textiles, for example a cloth.

It is, however, possible to consider an alternative configuration of the second flexible surface 308, such that the latter defines a volume offering resistance in the water and providing the connection between the floating element 304 and the second structure 307. To that end, the second flexible surface 308 could have a configuration related to that illustrated in FIG. 3, i.e., by arranging a strip of flexible material, for example a cloth, that would be stretched fixed on at least part of the two lower lateral bars 307*a*, 307*b*, and with an inner or outer edge on the floating element 304, so as to define a volume.

Figure 6:
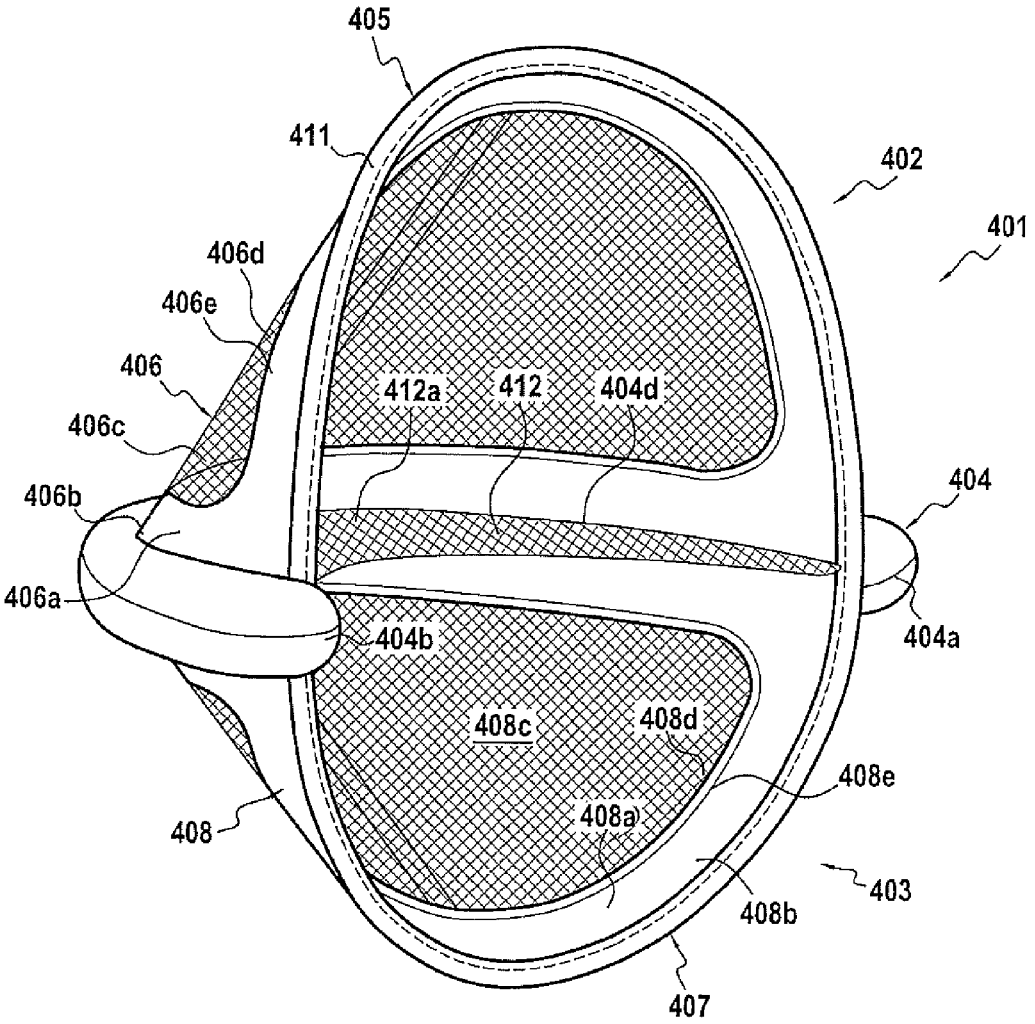
FIGS. 6, 7 and 8 illustrate another design alternative of the floating game device, in particular relative to the implementation of the first and second flexible surfaces.
Figure 7:
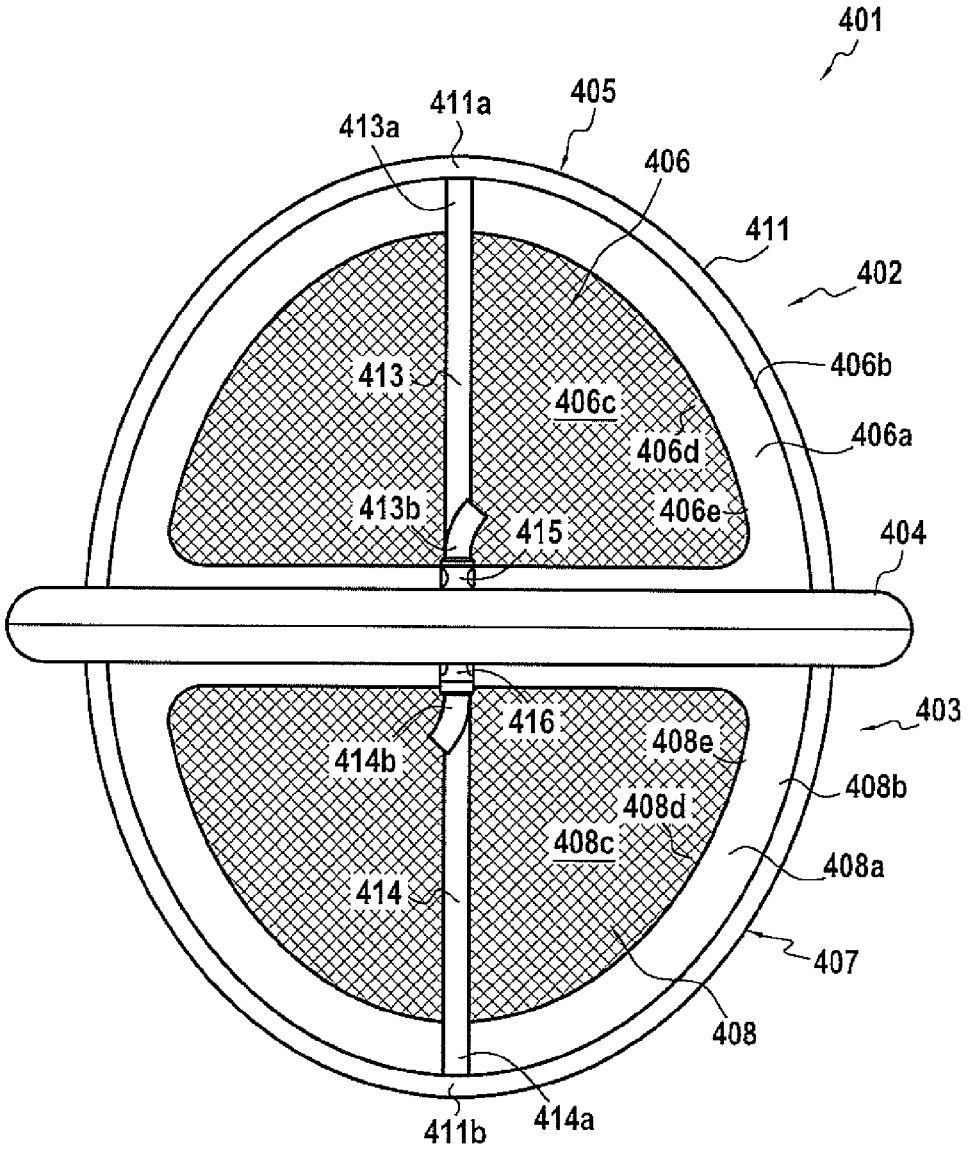
Figure 8:
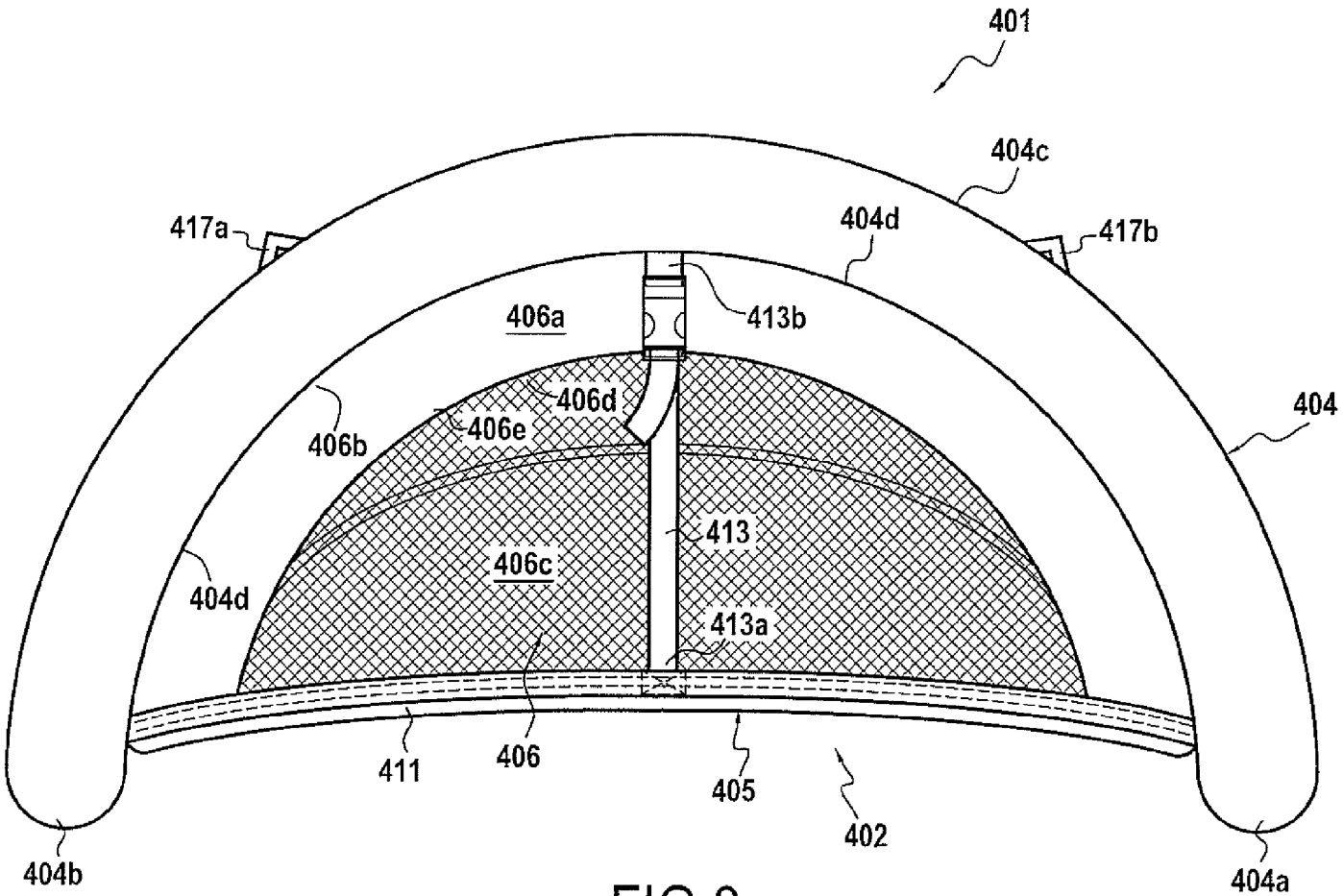

The design alternative of the floating game device 401 illustrated in FIGS. 6, 7 and 8 has a configuration similar to that of the floating game device 101 illustrated in FIG. 2, the essential difference pertaining to the implementation of the first flexible surface 406 and the second flexible surface 408. One can see in these FIGS. 6 to 8 that the first flexible surface 406 comprises a peripheral contour 406*a* including an outer edge 406*b* that is fastened on the inner edge 404*d* of the floating element 404 and is fixed to a sheath 411 in which a flexible arch is positioned making it possible to form the first structure 405 and the second structure 407, said sheath being fixed to the lateral ends 404*a*, 404*b* of the floating element 404. Furthermore, the first surface 406 comprises a net 406*c* that is positioned in the central part, said net 406*c* including a peripheral edge 406*d* that is fastened with the inner edge 406*e* of the peripheral contour 406*a*, as in particular illustrated in FIG. 6.

Likewise, the second flexible surface 408 comprises a peripheral contour 408*a* made from cloth, comprising an outer edge 408*b* fixed on the sheath 411 and the central net 408*c* whereof the peripheral edge 408*d* is fixed to the inner edge 408*e* of the peripheral contour 408*a*. The presence of a third flexible surface 412, for example made from cloth, is also visible, whereof the edge 412*a* is fixed on the inner edge 404*d* of the floating element 404.

These FIGS. 6 to 8 show the presence of two straps 413, 414 whereof the first ends 413*a*, 414*a* are fixed to the upper 411*a* and lower 411*b* parts of the sheath 411. The other two ends 413*d*, 414*b* are fixed across from the floating element 404 at its inner edge 404*d* as in particular illustrated in FIG. 8. The presence of fastening loops 415, 416 is shown making it possible to fix the ends 413*b*, 414*b* of the straps 413, 414 with the floating element 404. These fastening loops also make it possible to adjust the length of the straps 413, 414. This in particular has the advantage, particularly regarding the submerged part 403, of being able to exert tension on the second structure 407 so as to curve the latter backward, which makes it possible to reduce the height of the submerged part 403 and thus to install the floating game device 401 on a body of water having little bottom. FIG. 8 shows the presence of two fastening parts 417*a*, 417*b* arranged on the outer edge 404*c* of the floating element 404*a*. These fastening parts 417*a*, 417*b* make it possible to moor the floating game device 401 for example on the bottom of the pool, or to add additional ballasting means of the weight type, in particular when the floating game device is used on a highly agitated body of water. According to these different designs of the floating game device 1, 101, 201, 301, 401 illustrated in FIGS. 1 to 8, the submerged part 3, 103, 203, 303, 403 in all cases makes it possible to form a volume, in particular in the form of a pouch making it possible to increase the resistance of said floating game device in the water. These different designs show that the floating element is implemented using a fitting that is for example inflatable or formed so as to float on the water. This floating element 4, 104, 204, 304, 404 is furthermore fixed to the first and second structures as well as to the first and second flexible surfaces. It is of course possible to consider alternative designs of this floating element and for example to provide a flexible longilineal element, so as to be deformed and for example form a U or rectangular shape, said flexible longilineal material being inserted into a sheath that would be fixed to said first and second structures and said first and second flexible surfaces.

It is also possible to consider implementing this floating element in several parts, for example a first part fixed on one of the lateral sides of the first and second structures and a second floating element fixed on the other of the lateral sides of the first and second structures and a third floating element positioned in the rear part of the floating game device and fixed to the first and second flexible surfaces. It will be understood that in this case, the floating element can deform, which may tend to separate the first structure and the second structure. To that end, in this design scenario, a stiffening system is provided positioned between the lateral ends of the first structure and the second structure, or even between the floating elements, for example rigid straps or semi-rigid rods, which prevents the separation of said lateral sides of the first and second structures and the floating elements.

Other design embodiments may be considered without going beyond the scope of the present invention. It is in particular possible to consider combining the features of the different design embodiments of the floating game device illustrated in FIGS. 1 to 8, for example regarding the implementation of the fastening parts 417*a*, 417*b* or regarding the implementation of the tensing straps 414, 413.

It is also possible to consider design alternatives of the floating game device according to which the structures of the flexible surfaces on the above-water part and on the submerged part are configured to constitute two different games, such that inverting the floating game device makes it possible to play one or the other of the two games. For example, based on a configuration of the floating game device similar to that implemented in FIG. 1, 2, 3 or 6, regarding the floating structure, at the first and second structures and the first flexible surface, it is possible to consider the second flexible surface only being fixed on the second structure and in that case extending in the plane of said first and second structures. Thus, the above-water part constitutes a cage or goal and the submerged part constitutes a volleyball net.

The example embodiments shown in FIGS. 1 and 8 and described above further show that the first 5, 105, 205, 305, 405 and second 7, 107, 207, 307, 407 structures are positioned in a plane that is more or less perpendicular relative to the floating element 4, 104, 204, 304, 404 positioned in the waterline. It is, however, possible to provide design alternatives of the floating game device in which the first and second structures would be positioned in a plane forming an angle with the waterline different from 90° and preferably comprised between 30° and 150°.

The invention claimed is:

1. A floating game device comprising:

a submerged part, an above-water part, a floating element, the above-water part including a first structure and a first flexible surface supported by the first structure, the floating element defining a waterline that delimits the submerged part from the above-water part, and the submerged part comprising a second structure and a second flexible surface supported by the second structure, and an assembly element configured to keep the first structure and the second structure assembled with the floating element, in a single plane forming an angle with said waterline, said floating element having a part that is offset relative to the plane formed by the first and second structures, wherein the second flexible surface is configured on the submerged part to cause resistance in water, and wherein at least one of the first and second flexible surfaces are fixed with the part of the floating element that is offset relative to the plane formed by the first and second structures, said at least one of the first and second flexible surfaces extending between the structure of said at least one of the first and second flexible surfaces and the floating element offset relative to the plane formed by the first and second structures, so as to form a volume delimited by said at least one of the first and second flexible surfaces, by a plane defined by the at least one of the first and second structure, and by said waterline, such that a force exerted by the water on said part of the floating element can be transferred onto the above-water part or the submerged part.

2. The floating game device according to claim 1, wherein:

the floating element has a bowed configuration delimited by two lateral ends, an inner edge and an outer edge, the first structure is a first arch including two ends respectively subject to two side ends of the floating element;

the first flexible surface is configured to be fixed to the first arch and with one of the inner or outer edges of the floating element, in a more or less stretched position so as to form a cage.

3. The floating game device according to claim 2, wherein the second structure comprises at least two tubular portions respectively subjected to the two lateral ends of the floating element, the second flexible surface being configured to be fixed to the two tubular portions in the plane of the second structure.

4. The floating game device according to claim 2, wherein the floating element is crescent-shaped or comprises a toroid-shape portion.

5. The floating game device according to claim 4, wherein the floating element is crescent shaped and the first flexible surface and the second flexible surface are fixed on the outer edge of the floating element.

6. The floating game device according to claim 4, wherein the floating element comprises a toroid-shape portion and the first flexible surface and the second flexible surface are fixed on the inner edge of the floating element.

7. The floating game device according to claim 2, wherein the floating element comprises a toroid-shape portion, and wherein the floating game device further comprises a third flexible surface extending toward the inside of the floating element from the inner edge of said floating element, in the waterline.

8. The floating game device according to claim 1, wherein the assembly element is configured to bend the first and second structures, and a return element is configured to exert a force on the first structure and on the second structure so as to position them naturally in a perpendicular position relative to the floating element.

9. The floating game device according to claim 8, wherein a tensing system is arranged between the floating element and at least the second structure to curve the second structure relative to the floating element, so as to limit the bulk of said second structure heightwise.

10. The floating game device according to claim 1, wherein the floating element has a rectangular shape comprising two lateral sides and two longitudinal sides.

11. The floating game device according to claim 10, wherein the second structure comprises at least two lower lateral bars respectively subjected to the two lateral sides of the floating element, the second flexible surface being configured to be fixed to the two lower lateral bars and to an inner or outer edge of the floating element, in a more or less stretched position so as to form a volume.

12. The floating game device according to claim 10, wherein the first structure comprises at least two upper lateral bars respectively positioned on the two lateral sides of the floating element and extending perpendicular to the floating element, the first flexible surface being fixed to the two upper lateral bars.

13. The floating game device according to claim 10, wherein the second structure comprises two lower lateral bars and a transverse lower bar that are positioned in a U, the two lower lateral bars being fixed to the lateral sides of the floating element, the second flexible surface having a rectangular shape comprising two longitudinal ends that are fixed to the longitudinal sides of the floating element, said second flexible surface being kept stretched bearing against the transverse lower bar.

14. The floating game device according to claim 1, wherein at least one fastening system is configured on the floating element to allow mooring or additional ballasting of said floating element.

15. The floating game device according to claim 1, wherein the first flexible surface is a net.

16. The floating game device according to claim 2, wherein the first flexible surface includes a peripheral contour made from cloth whereof an outer edge is fixed to the floating element and to the first structure and a central net whereof a peripheral edge is fixed to an inner edge of said peripheral contour.

17. The floating game device according to claim 1, wherein the second flexible surface is made from a textile, for example cloth.

18. The floating game device according to claim 1, wherein a sheath is fixed to the first and second structures, the floating element being flexible and configured to be inserted into the sheath.

19. The floating game device according to claim 1, wherein the floating element is deformable, a stiffening system being configured to stiffen the first and second structures and keep them in a stable position.

20. The floating game device according to claim 1, wherein the floating element is made up of several floating parts.

21. The floating game device according to claim 1, wherein the angle formed between the plane in which the first and second structures are situated and the waterline in which the floating element is situated is comprised between 30° and 150°.

22. A floating game device comprising:

a submerged part, an above-water part, a floating element, the above-water part including a first structure and a first flexible surface supported by the first structure, the floating element defining a waterline that delimits the submerged part from the above-water part, and the submerged part comprising a second structure and a second flexible surface supported by the second structure, and an assembly element configured to keep the first structure and the second structure assembled with the floating element, wherein said floating element has a bowed configuration delimited by two lateral ends, an inner edge and an outer edge, wherein the first and second flexible surfaces are configured to be fixed with one of the inner or outer edges of the floating element, wherein the first and second structures form a single and same flexible arch, and wherein the first and second flexible surfaces extend respectively between the first and second structures and the floating element so as to form a volume delimited by said first and second flexible surface and a plane defined by the first and second structures.

23. The floating game device according to claim 22, wherein said single and same flexible arch is closed on itself.

24. The floating game device according to claim 22, wherein a tensing system is arranged between the floating element and at least the second structure to curve the second structure relative to the floating element, so as to limit the bulk of said second structure heightwise.

25. The floating game device according to claim 22, wherein the first flexible surface is a net.

26. The floating game device according to claim 22, wherein the second flexible surface is made from a textile, for example cloth.

27. The floating game device according to claim 22, wherein the first flexible surface includes a peripheral contour made from cloth whereof an outer edge is fixed to the floating element and to the first structure and a central net whereof a peripheral edge is fixed to an inner edge of said peripheral contour.

28. The floating game device according to claim 22, wherein the floating element is made up of several floating parts.

* * * * *